United States Patent [19]

Godley et al.

[11] 4,389,000

[45] Jun. 21, 1983

[54] NEWSPAPER VENDING MACHINE

[75] Inventors: Fred O. Godley; John A. Laurents, both of Charlotte, N.C.

[73] Assignee: Single Vend Inc., Charlotte, N.C.

[21] Appl. No.: 283,071

[22] Filed: Jul. 13, 1981

[51] Int. Cl.[3] ..... G07F 11/60

[52] U.S. Cl. ..... 221/8; 194/37; 221/226

[58] Field of Search ..... 221/227, 289, 226, 213, 221/225, 214, 215, 217, 279, 195, 8; 194/37

[56] References Cited

U.S. PATENT DOCUMENTS 4,139,120 2/1979 Moore ..... 221/213

*Primary Examiner*—Stanley H. Tollberg

*Attorney, Agent, or Firm*—Clifton T. Hunt

[57] ABSTRACT

A newspaper vending machine having a vertically movable inclined platform supporting a group of newspapers, a stationary dispensing wedge having an inclined upper surface, a drive shaft operatively connected to the platform, a dispensing chute and a crank to rotate the shaft to elevate the platform and raise successive newspapers above the dispensing wedge and dispense them by gravity through a dispensing chute, in combination with a clutch between the drive shaft and the crank normally disengaging the shaft from the crank, and a coin mechanism to activate the clutch and engage the shaft with the crank to raise the platform and dispense a newspaper.

7 Claims, 19 Drawing Figures

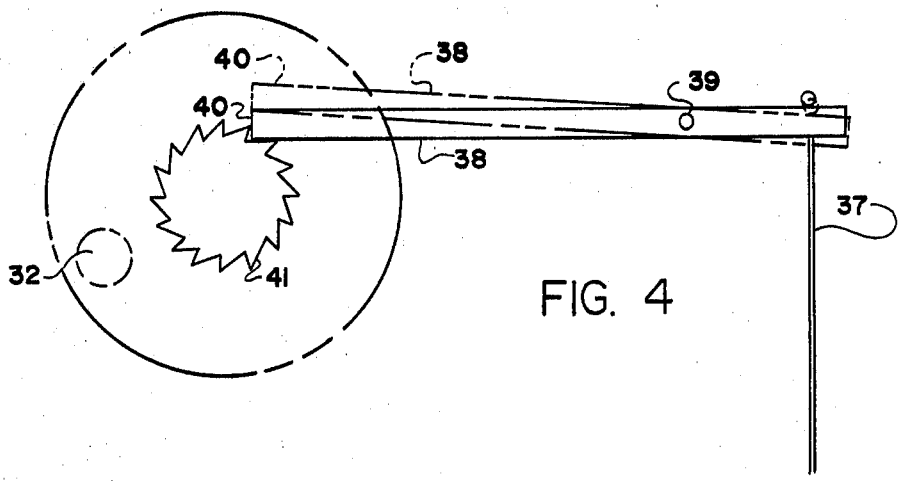
FIG. 4
FIG. 5
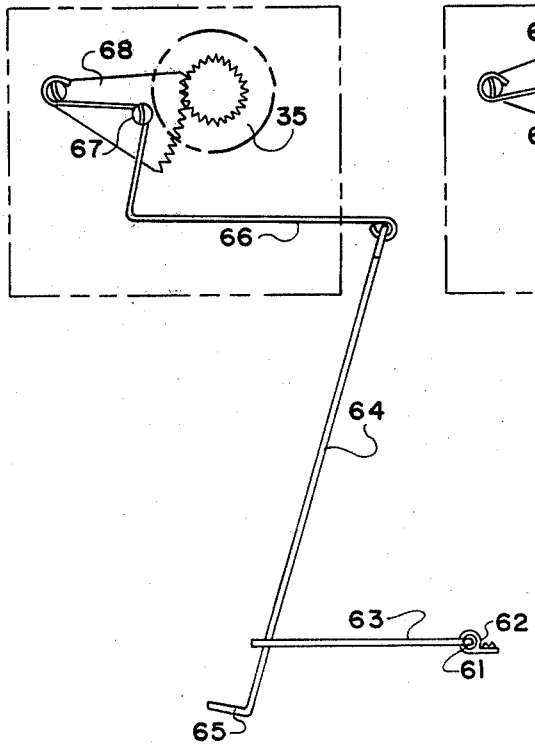
FIG. 6
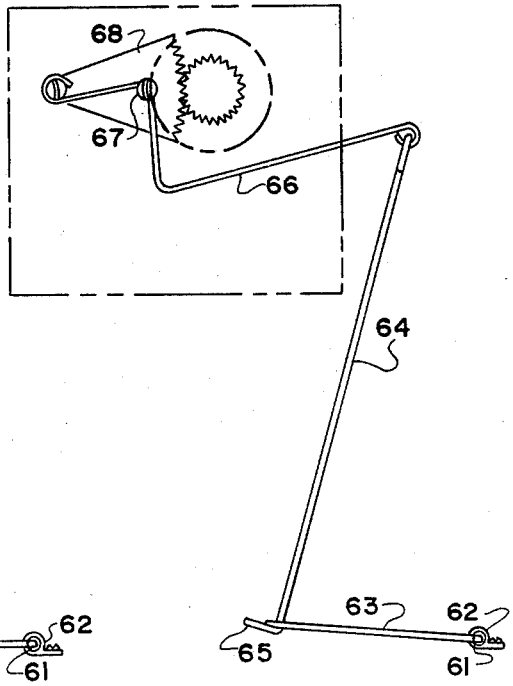

NEWSPAPER VENDING MACHINE

BACKGROUND OF THE INVENTION

The sale of newspapers through vending machines is common practice throughout the country. Most newspaper vending machines are coin actuated and responsive to the insertion of the proper coinage to permit the purchaser to open the door to the vending machine and thereby have access to all of the papers in the machine. This places the newspaper vendor at the mercy of the purchaser and relies on the honesty of the purchaser to protect the vendor's investment. This has proven unsatisfactory in some cases.

Prior attempts have been made to produce a vending machine to dispense only a single copy of newspaper in response to the deposit of appropriate coinage. The limited use of machines to vend single copies of newspapers is stark evidence that the single copy machines have not been developed to a commercially acceptable standard. Pending application Ser. No. 162,938 filed June 25, 1980 now U.S. Pat. No. 4,312,461 by Fred O. Godley and entitled NEWSPAPER VENDING MACHINE is the closest approach to a commerically acceptable single paper vending machine known to applicants.

SUMMARY OF THE INVENTION

The vending machine of the present invention is an improvement of the subject matter disclosed in said prior application and utilizes the same concept of supporting a supply of newspapers with one flat side down on a forwardly and downwardly inclined vertically reciprocable platform with the folded edges of the paper resting against a vertically positioned stationary dispensing wedge and an elevating mechanism responsive to insertion of a predetermined amount of coins to dispense a single copy. The dispensing mechanism for elevating the platform and the locking of the dispensing mechanism after a paper is released have been simplified, and a novel apparatus has been devised for notifying prospective purchasers that the last paper has been sold.

It is an object of this invention to provide a newspaper vending machine which can be bulk loaded without regard to the thickness of the individual papers and which will reliably dispense a single newspaper and automatically lock the dispensing mechanism against release of further newspapers until the proper coinage is again inserted into the machine.

It is a further object of the invention to provide a newspaper vending machine of the type described wherein insertion of a predetermined amount of coins in the machine automatically results in the machine being activated to permit operation of the mechanism to dispense only a single copy of the newspaper.

A further object of the invention is to provide a newspaper vending machine of the type described wherein the dispensing of a single copy of a newspaper operates a locking latch which first locks the dispensing mechanism against further operation and then resets the coin controlled mechanism in position to receive a succeeding predetermined amount of coins to dispense a succeeding newspaper.

Another object of the invention is to provide a single copy newspaper vending machine wherein the supply of newspapers within the machine are not visible to the prospective purchasers but wherein a single display copy of the newspaper is visible to prospective purchasers to inform them of the contents of the machine, and wherein means are provided for dispensing the displayed copy of the newspaper only after all the other papers have been dispensed and to thereafter display a message that the machine is empty.

Some of the objects of the invention having been stated other objects will appear as the description proceeds when taken in connection with the accompanying drawings.

BRIEF DESCRIPTION OF THE DRAWINGS

FIG. 4 is a schematic side elevation, with parts broken away, of the clutch and crank illustrating the activating lever in the inoperative clutch engaging solid line position and in the operative dotted line position releasing the clutch;

FIG. 5 is a schematic side elevation illustrating the position of the coin controlled linkage in the rest or inoperative position ready to receive a predetermined amount of coins to activate the dispensing mechanism;

FIG. 6 is a schematic side elevation similar to FIG. 5 but illustrating the linkage in the activated or operative position after the predetermined amount of coins has been deposited but before the newspaper is dispensed;

DETAILED DESCRIPTION OF THE INVENTION

Figure 1:
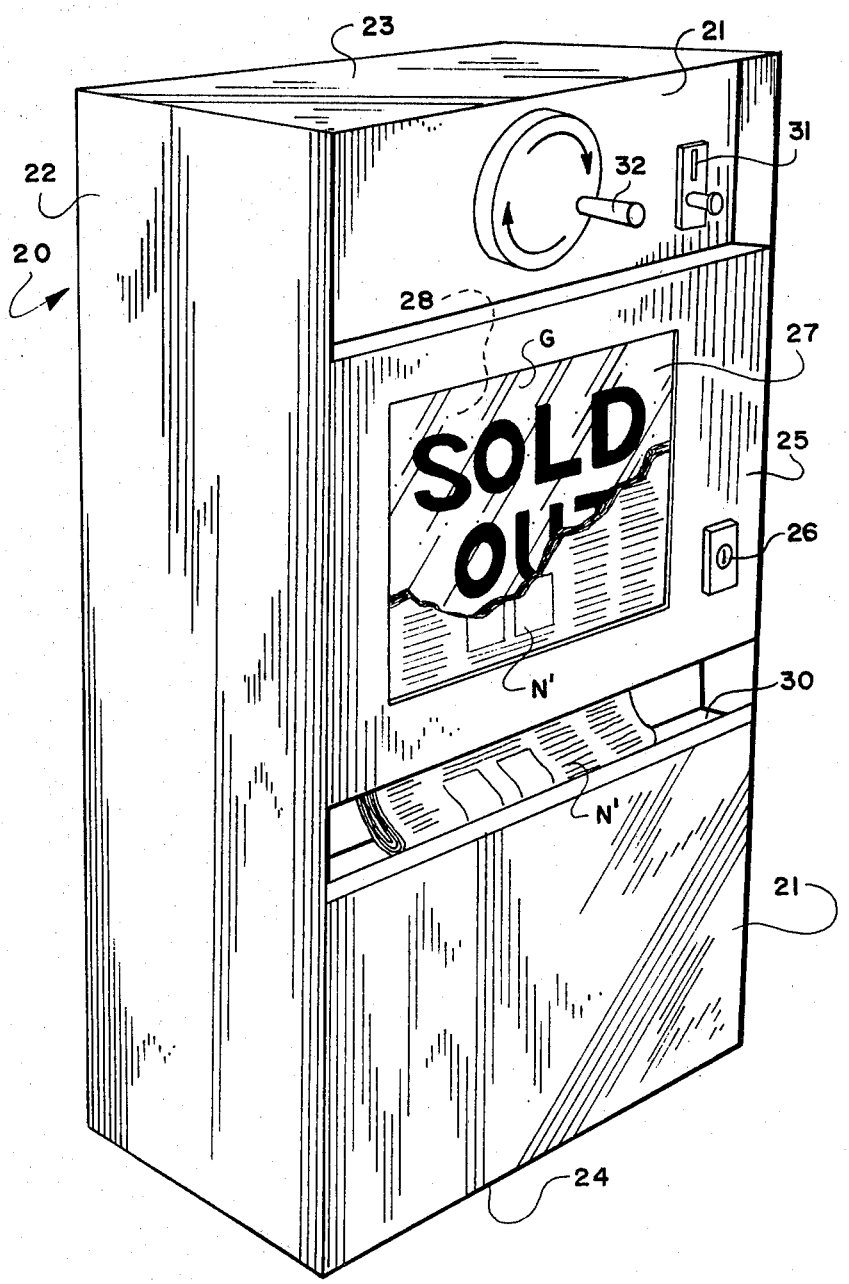
FIG. 1 is a perspective view looking at the front and one side of the newspaper machine and with part of the displayed newspaper broken away to illustrate a message that is automatically displayed when the last paper is vended.
Figure 2:
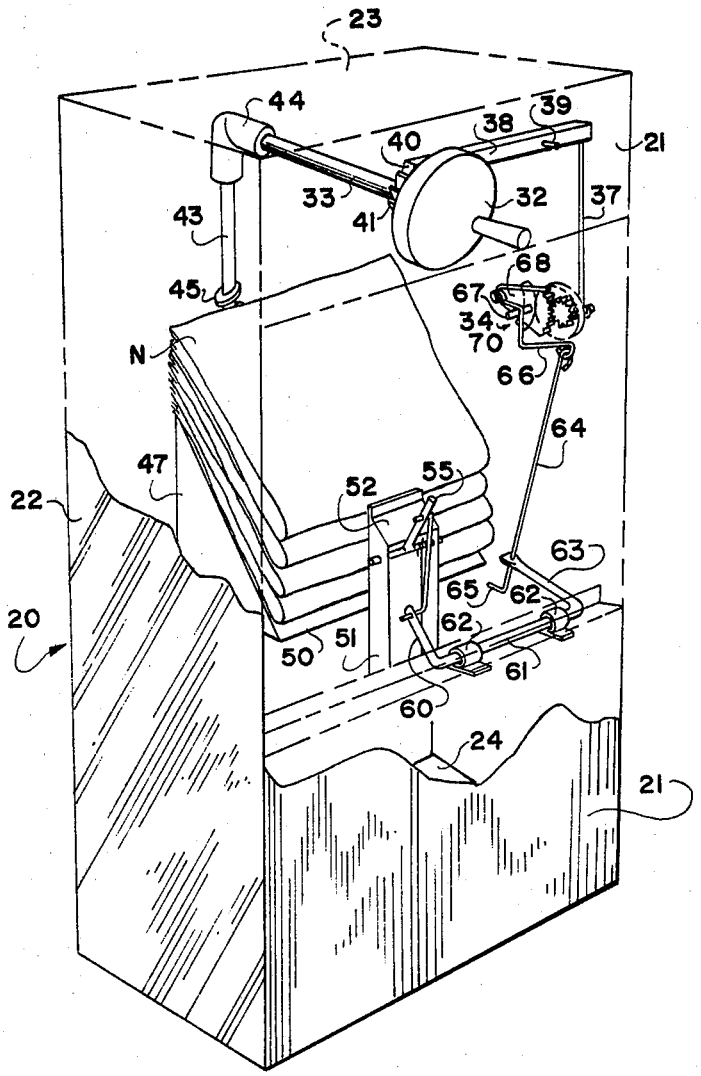
FIG. 2 is a perspective view of the newspaper vending machine similar to FIG. 1 but with parts broken away to illustrate the dispensing and locking mechanisms.

Referring more specifically to the drawings the numeral 20 broadly indicates a newspaper vending machine comprising a front wall 21, side walls 22, a top wall 23 and a base 24. The front wall 21 includes a door 25, closable to undesired entry by a lock 26 and including a glass covered display area 27 which houses a display newspaper representative of the supply of newspapers within the machine. As most clearly seen in FIG. 8, the display area 27 includes a transparent front wall G and a rear wall 28, on the front of which is printed a message "sold out" which becomes visible when the last newspaper is dispensed.

Successive copies of newspapers are dispensed into a tray 30 formed integral with the door 25 beneath the display area 27 following the insertion of a predetermined amount of coins within a coin slot 31 in the front wall 21 and the manipulation of a rotatable crank 32 fixed to the forward end of a drive shaft 33 journaled in the front wall 21 and extending therethrough.

THE DISPENSING MECHANISM

Figure 3:
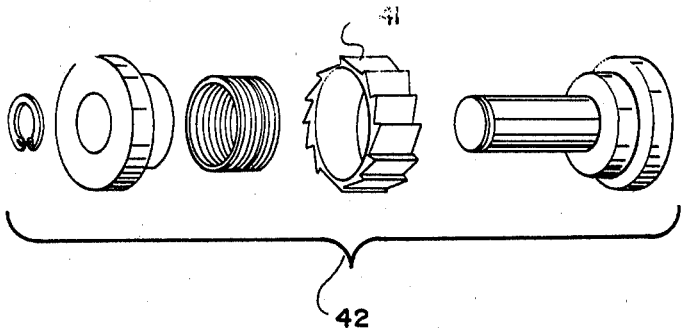
FIG. 3 is an exploded perspective view of a clutch which forms a part of the dispensing mechanism.
Figure 9:
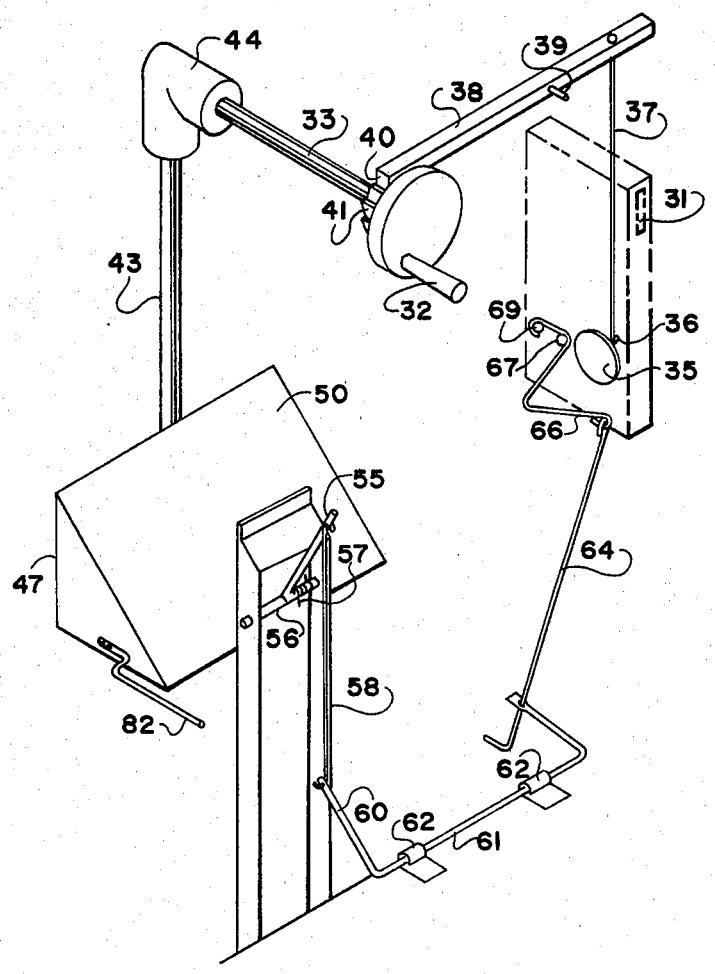
FIGS. 9, 10 and 11 are somewhat schematic sequential views illustrating the dispensing and locking mechanism in the rest or inoperative position, the activated position and the dispensing and locking position.

Referring to FIG. 9, the coin slot 31 is operatively connected to conventional coin mechanisms which may be of the types manufactured by Coin Acceptors Inc., 4947 Daggett Ave., St. Louis, Mo. 63110 as their Model No. 790-15 and by National Rejectors Industries, P.O. Box 1150 Hot Springs, Ark. 71901 as their Model No. 13-03-068. These conventional coin mechanisms accept coins of different values and are conventionally adjustable to require the deposit of different amounts of coins to vend the papers, such as 25 cents for a daily paper and 75 cents for a Sunday paper. More specifically, the coin mechanism 34 includes a price indexing dial 35 having formed integral therewith a boss 36. According to the present invention, a link 37 extends upwardly from the boss 36 to the fixed end of a horizontally disposed activating lever 38 pivotally connected as at 39 (FIG. 9) to the inner surface of the front wall 21 and having a free end 40 engagable with the ratchet 41 of a wrap spring clutch 42 (schematically illustrated in FIG. 3) on the drive shaft 33.

Figure 10:
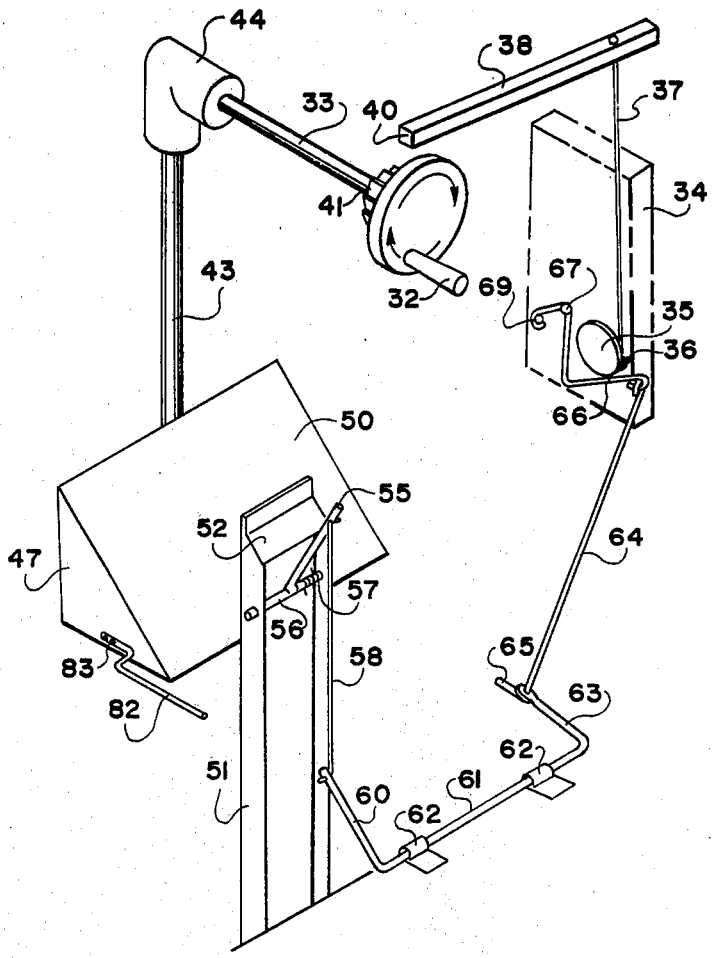

The dial 35 is rotated on its axis to set the price at which the dispensing mechanism will become activated to permit the dispensing of a newspaper. For example, assuming it is desired to dispense newspapers at 75 cents each, the dial 35 is rotated until the boss 36 is at about the 12 o'clock position as shown in FIG. 9. The dial 35 and its boss 36 indexes in a clockwise direction as successive coins are fed into the mechanism 34 through the slot 31. When the predetermined amount of 75 cents has been received the boss 36 will have been indexed from its initial rest or inoperative position at about 12 o'clock as shown in FIG. 9 to its activating or operative position at about 5 o'clock as shown in FIG. 10. Movement of the boss to its activating position at about the 5 o'clock location moves the vertically extending link 37 down sufficiently to pivot the free end of lever 38 upwardly out of engagement with ratchet 41 to establish operative connection between the crank 32 and drive shaft 33. Rotation of the crank 32 by the purchaser dispenses a newspaper into the tray 30.

The clutch 42 is a wrap spring clutch and may be of the type manufactured by Warner Electric Company of 449 Gardner St., South Beloit, Ill. 61080, under Model No. PSI 2. The clutch 42 selectively establishes operative connection between the crank 32 and shaft 33 and is preferably of the type that will permit relative rotation between the crank 32 and shaft 33 when the dispensing mechanism is in rest or inoperative position with the ratchet 41 engaged by the free end 40 of the lever 38. Such an arrangement has the advantage of minimizing vandalism by permitting idle rotation of the crank 32 until a predetermined value of coins has been inserted in the slot 31. Such idle rotation of the crank 32 with lever 38 engaging ratchet 41 does not rotate the shaft 33 and does not dispense a newspaper. However, upon insertion of the proper coinage through the slot 31 and into the coin mechanism 34 to move the boss 36 to the activating position of FIG. 10, the resulting downward movement of link 37 and disengagement of lever 38 from ratchet 41 results in establishment of operative connection between crank 32 and shaft 33 so that rotation of crank 32 causes corresponding rotation of shaft 33 to impart rotation to a vertical shaft 43 through a right angular gear box. The gearing in box 44 preferably establishes a 2 to 1 ratio between the horizontal drive shaft 33 and the vertical drive shaft 43 so that the horizontal shaft 33 has to be rotated twice to impart one revolution to the vertical shaft 43. This makes it easier to lift a heavy stack of papers and also minimizes the accidental dispensing of two or more thin newspapers.

The vertical shaft 43 is fixed for rotation with a vertically extending acme rod 45 journaled in the base 24 of the vending machine. A split nut assembly broadly indicated at 46 connects a newspaper support platform 47 to the acme rod and rotation of the shaft 43 and its acme rod 45 causes upward vertical movement of the platform 47 within the machine 20. The split nut assembly 46 includes a handle 48 which may be manipulated to quickly lower the platform 47 toward the base 24 of the machine preparatory to loading a supply of newspapers on the forwardly and downwardly inclined surface 50 of the platform 47. As the platform 47 moves vertically on the acme rod 45, the lower front edge of the platform traverses closely adjacent a vertically rising stationary dispensing wedge 51 including a forwardly and downwardly extending upper surface 52 (FIG. 7).

Figure 7:
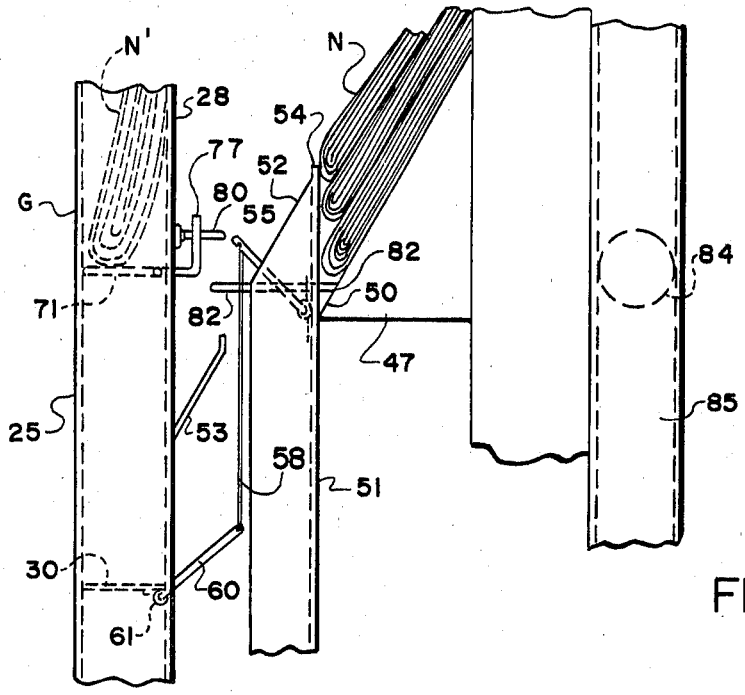
FIG. 7 is a somewhat schematic side elevation, with parts broken away, illustrating the relative locations of the newspapers within the machine awaiting deposit of the proper coinage.

With a supply of newspapers N on the inclined platform 50 and with the door 25 closed in its operative position as shown in FIG. 7, the upper inclined surface 52 of the stationary dispensing wedge 51 is angularly aligned with a dispensing chute 53 extending inwardly from the door 25 and terminating in spaced relation from the dispensing wedge 51. The door 25 has an opening in its inner wall above the dispensing chute 53 to receive successive newspapers and deliver them into the tray 30 where it may be reached by the purchaser outside the vending machine.

Figure 7A:
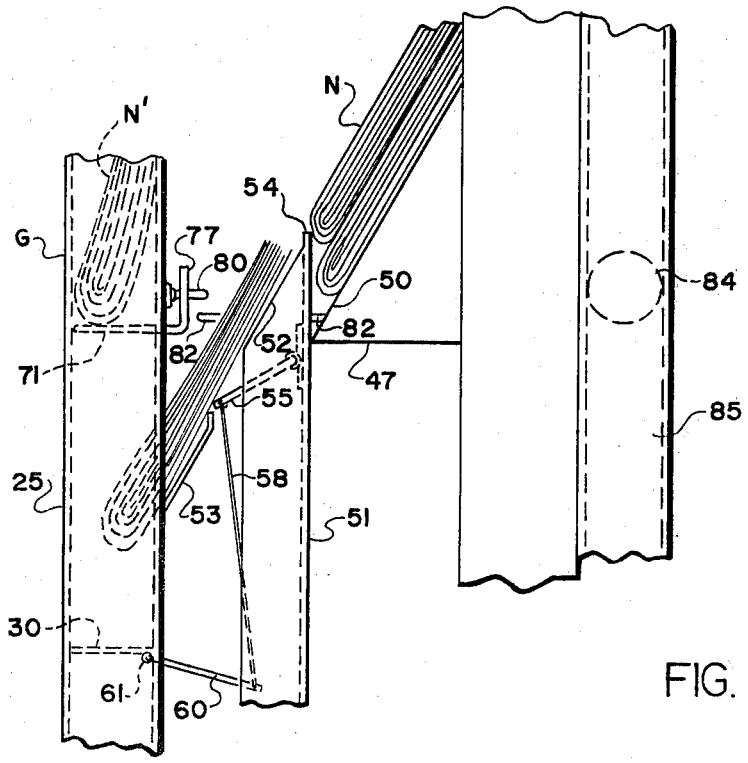
FIG. 7A is a somewhat schematic view, with parts broken away, similar to FIG. 7 and illustrating the passage of a single copy of a newspaper across the dispensing wedge and in engagement with the locking latch as the newspaper enters the dispensing chute.

In summary, the dispensing mechanism functions as follows: After a purchaser has deposited the preset price of a newspaper in the coin slot 31, the coin mechanism 34 moves the price indexing disc 35 and its boss 36 from the rest or inoperative position shown in FIG. 10 to disengage lever 38 from ratchet 41 of clutch 42 and establish operative connection between crank 32 and shaft 33, whereupon rotation of the crank 32 in a clockwise direction rotates the shaft 33 twice for each revolution of vertical shaft 43 and acme rod 45 to elevate the platform 47 along the dispensing wedge 51 until the top-most newspaper on the platform is elevated above the upper edge 54 of the dispensing wedge 51 (FIGS. 7 and 7A) where it moves by gravity across the inclined surface 52 of dispensing wedge 51 and across the chute 53 in the door 25 before coming to rest in the tray 30 where it may be removed from the machine.

THE LOCKING MECHANISM

A pivotal locking latch 55 is spring biased into the path of successive newspapers N as they cross the inclined face 52 of the dispensing wedge 51. As most clearly seen in FIGS. 9 and 10, the locking latch 55 extends upwardly and outwardly at an angle from a horizontally disposed shaft 56 journaled in the side walls of the dispensing wedge 51. A spring 57 is mounted on the shaft 56 and normally urges the locking latch 55 into the upper position illustrated in FIGS. 9 and 10. Movement of a newspaper N across the inclined face 52 depresses the latch 55 to the downward position shown in FIG. 7A and causes corresponding downward movement of link 58 extending between the latch 55 and an arm 60 extending in right angular relation from a horizontally extending shaft 61 journaled as at 62 to the front wall 21 of the machine. Another arm 63 extends in right angular relation from the shaft 61 beneath the coin mechanism 34 and the free end of arm 63 slidably receives a vertically extending link 64 curved to form a stop 65 beneath the arm 63 and fastened at its upper end to one end of a reset lever 66.

The reset lever 66 is of angular configuration and its other end is anchored to the housing of the coin mechanism 34. An angled portion of the lever 66 extends over a stub shaft 67 protruding from a segmental gear 68 of the coin mechanism 34 and movable therewith through an arc 70. The segmental gear 68 and its stub shaft 67 are movable with the price index disc 35 and the boss 36. As the boss 36 is rotated downwardly in a clockwise direction in response to coins being inserted into the mechanism 34, the stub shaft 67 is correspondingly raised through the arc 70.

Figure 11:
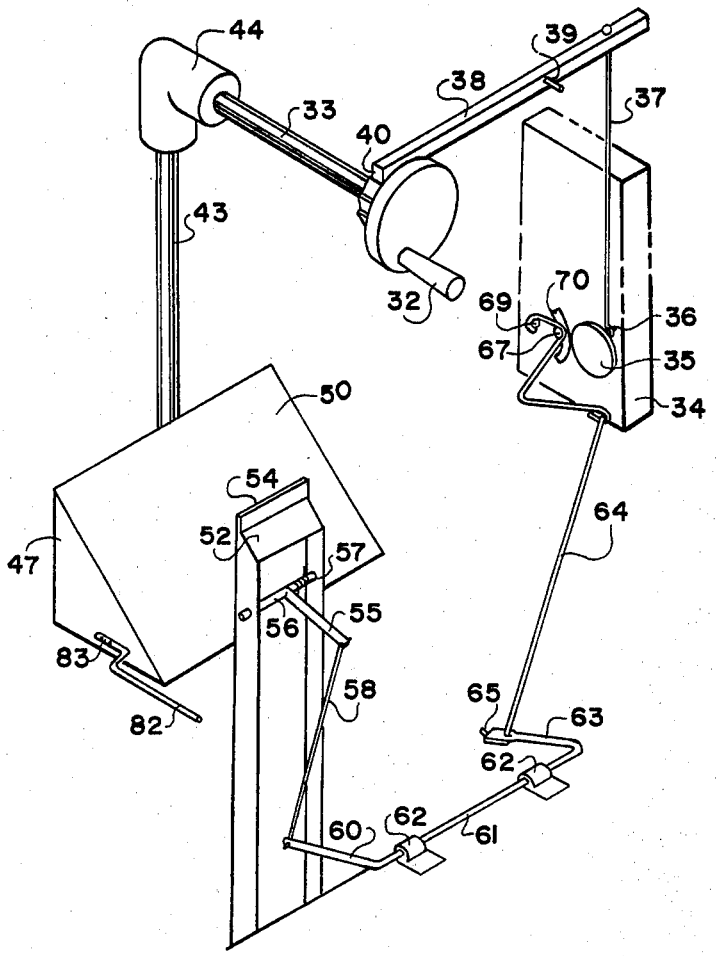

Depression of the locking latch 55 by a dispensed newspaper depresses link 58 and its attached arm 60 causing rotation of shaft 61 to depress arm 63 and its attached link 64. Link 64 moves the stub shaft 67 and its segmental gear downwardly to impart counterclockwise rotation to the disc 35 returning the boss 36 to its elevated inoperative or rest position as seen in FIG. 11. The elevation of the boss 36 from its operative 5 o'clock position toward its inoperative 12 o'clock position raises the link 37 and immediately lowers the free end 40 of the lever 38 into engagement with the ratchet 41 of clutch 42 to disengage drive shaft 33 from operative connection with crank 42. Therefore, although crank 32 may continue to be rotated its movement will not be transmitted to the shaft 33 and the newspaper supply platform will not rise to dispense another paper until the proper coinage is inserted in the slot 31.

When the boss 36 is returned to its rest position at the 12 o'clock location the coin mechanism is fully reset to receive additional coinage to activate the dispensing mechanism to permit the dispensing of another paper. This process is repeated until the supply of papers on the platform 47 is exhausted.

DISPENSING THE FINAL PAPER

Each time a supply of newspapers is loaded into the machine by placing a stack of papers on the inclined surface 50 of platform 47 the vendor positions a display copy N' of the newspapers within the display area 27 to cover the "sold out" sign on the back wall 28 and to exhibit the front page of the newspaper through the glass G. The folded edge of the displayed newspaper N' is supported on a pivotal rack 71 journaled as at 72 to side walls 73 of the display area 27 (FIG. 8).

Figure 8:
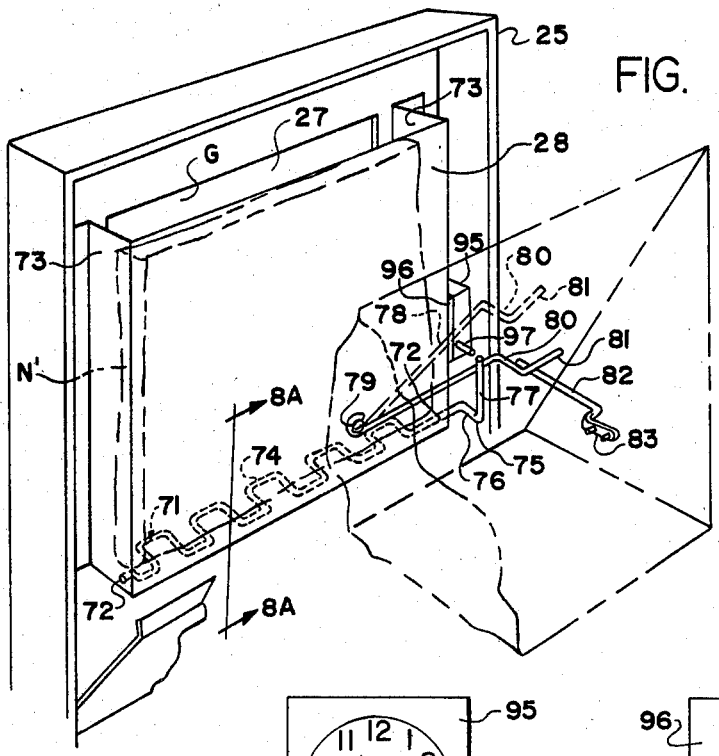
FIG. 8 is a fragmentary perspective view looking at the inside of the door of the vending machine, with parts broken away, and illustrating the support of the display newspaper and the mechanism for vending it.
Figure 8C:
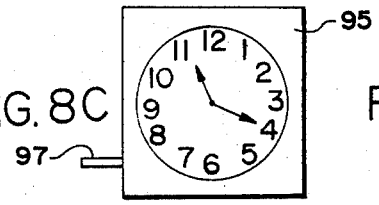
FIG. 8C is a front elevation of the magnetically supported clock removed from the display area.
Figure 8D:
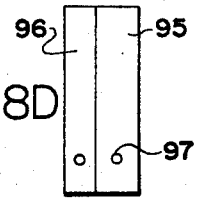
FIG. 8D is a side elevation of the clock shown in FIG. 8C.

The rack 71 is illustrated as being of a serpentine configuration comprising a series of integrally formed U-shaped portions projecting forwardly of the pivotal axis defined by the pivot points 72 on the side walls 73 in FIG. 8. Thus, the pivotal connection of the rack 71 to the side walls 73 is in offset relation to the weight of the rack so that gravity causes the rack 71 to normally extend downwardly from its pivotal connection to the side walls 73, as shown in FIG. 8B. The rack 71 includes an extension 75 extending through one side wall 73 and bent rearwardly as at 76 in FIGS. 8 and 8A and then upwardly to define a locking arm 77. A pivotal latch 78 is pivotally connected to the rear wall 28 of display area 27 as at 79 and extends in parallel relation to the rear wall 28 beyond the locking arm 77 and includes a rearwardly extending leg 80 and laterally extending latch portion 81 (FIGS. 8, 8A and 8B) beyond the locking arm 77.

Figure 8A:
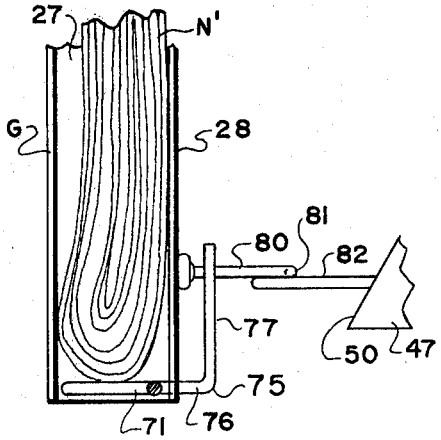
FIG. 8A is a vertical sectional view taken substantially along the line 8A—8A in FIG. 8.
Figure 8B:
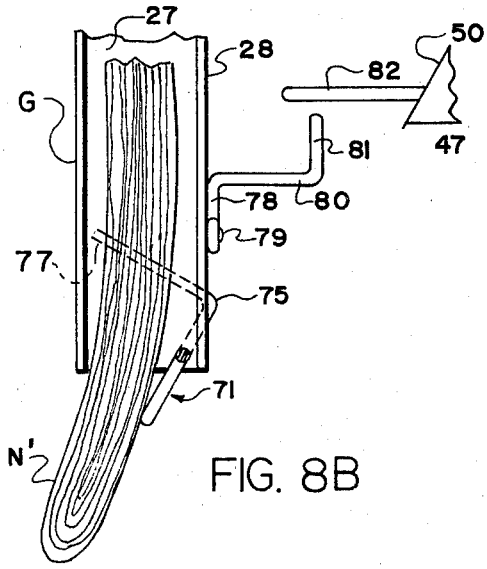
FIG. 8B is a view similar to FIG. 8A but illustrating the dispensing of the display newspaper as its support is released.

In practice the rack 71 is positioned and locked in the newspaper supporting position of FIG. 8A by moving the locking arm 77 rearwardly to pivot the rack 71 upwardly to its newspaper supporting horizontal position and then moving the pivotal latch 78 in front of the upstanding locking arm 77 to maintain the rack 71 in the horizontal newspaper supporting position of FIG. 8A.

A stationary rod 82 is secured as at 83 to a side wall of the newspaper supply platform 47 and projects forwardly therefrom. The latch portion 81 on pivotal latch 78 lies in the path of the fixed rod 82 as the platform 47 is indexed upwardly by successive rotations of crank 32 to dispense newspapers. After the last newspaper is dispensed from the supply platform 47 the fixed rod 82 is located immediately beneath the latch portion 81 as illustrated in FIG. 8A and in the solid line position of the latch portion 81 in FIG. 8.

The next time the crank 32 is rotated by a purchaser to dispense a newspaper the supply platform 47 is elevated as previously described and the continued upward movement of the empty platform engages the rod 82 with the latch portion 81 and raises the latch portion 81 out of engagement with locking arm 77 to the dotted line position shown in FIG. 8 enabling the rack 71 to gravitate downwardly and dispense the display paper N' as shown in FIG. 8B. The dispensing of newspaper N' reveals the "sold out" sign on the front of rear wall 28.

LOADING THE MACHINE

The appearance of the "sold out" sign in the display area 27 serves as notice to prospective purchasers that the machine is empty. It also notifies the vendor that it is time to replenish the supply of newspapers within the machine. The vendor gains access to the interior of the machine by inserting an appropriate key in the lock 26 and opening the door 25. The rack 47 will be in its elevated position above the dispensing wedge 51. The vendor must lower the platform 47 sufficiently below the upper edge 54 of stationary dispensing wedge 51 to receive the desired number of newspapers to be vended. In many instances this will require the platform 47 to be lowered as far as possible.

Figure 14:
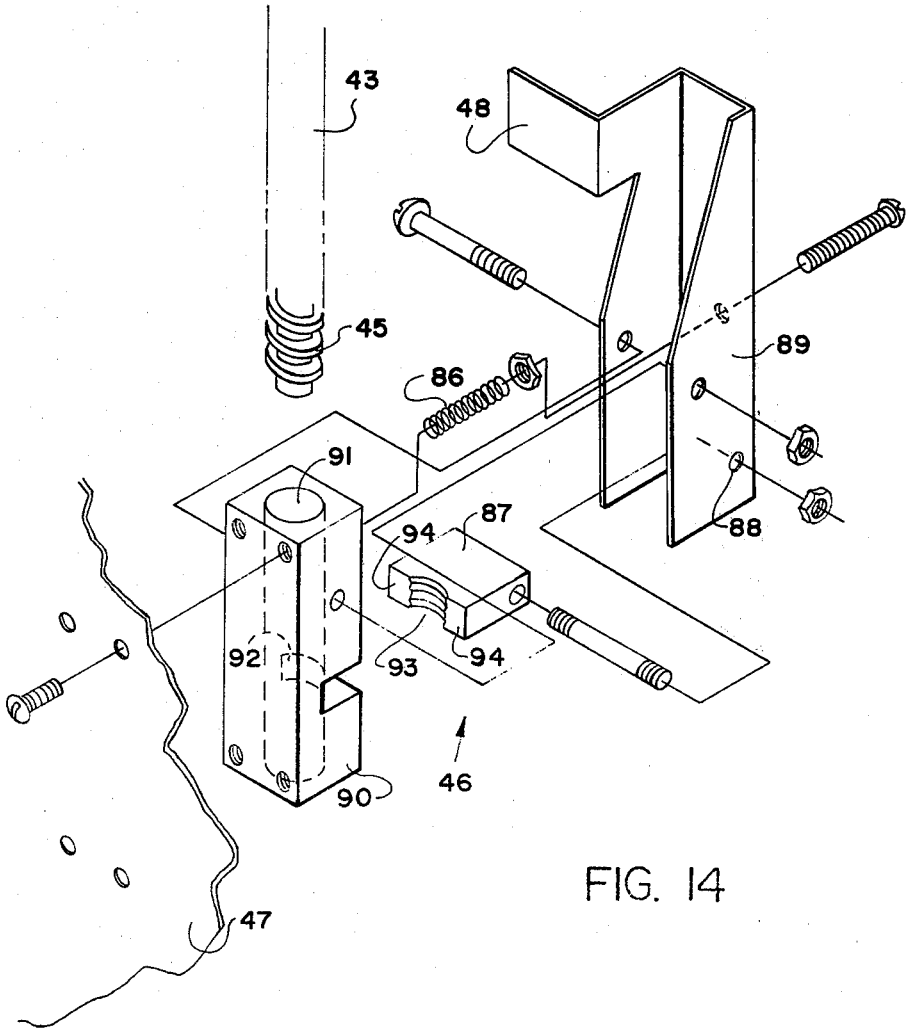
FIG. 14 is an exploded perspective view illustrating the components for releasing the vertically movable inclined platform preparatory to lowering it to receive a fresh supply of newspapers.
Figure 13:
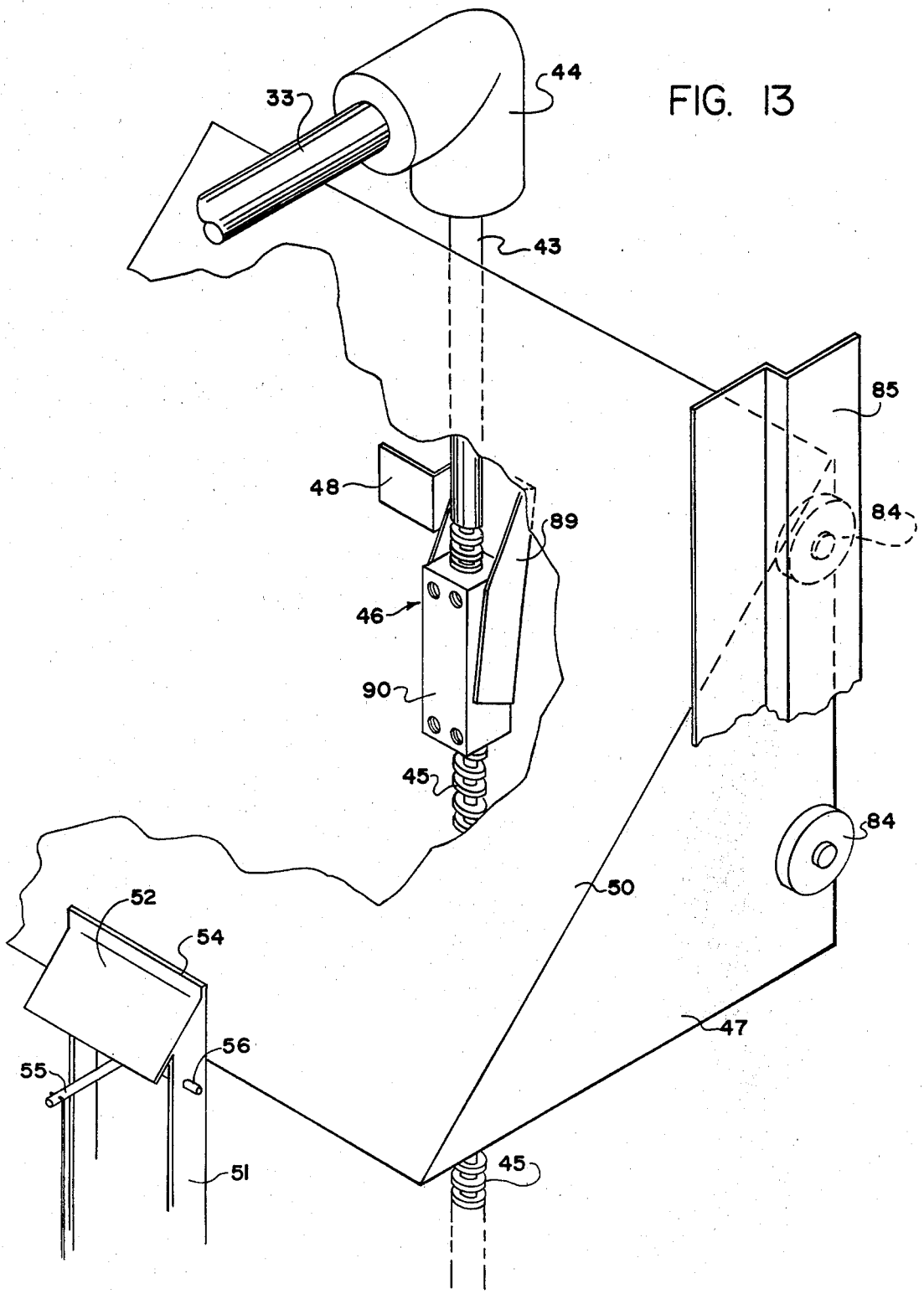
FIG. 13 is a perspective view, with parts broken away, illustrating the mechanism for supporting the inclined platform.

Referring now to FIG. 13, the platform 47 is attached to the acme rod 45 by the block and split nut assembly 46 and the platform 47 is stabilized by rollers 84 and vertically extending guide tracks 85 at the sides of the platform. To lower the platform the vendor reaches behind the platform to grasp the handle 48 on the assembly 46 and pull it forwardly to overcome a spring 86 within the assembly 46 and pivot a split nut portion 87 away from acme rod 45. The split nut portion 87 is pivotally mounted as at 88 on the handle housing 89 (FIG. 14). The block portion 90 of the assembly 46 is permanently attached to the rear of the supply platform 47 and has a vertically extending tubular opening 91 to receive the acme rod 45. The block 90 also has a smooth walled transversely extending arcuate passageway 92 communicating with the tubular opening 91 to receive the split nut portion 87. In use, the threads 93 on the split nut portion 87 overlap the threads on the acme rod 45 but do not bear against them because the shoulders 94 on the split nut portion 87 engage the block 90 at the ends of the arcuate opening 92 to prevent binding of the threads 93 and the acme rod 45.

The forward movement of the handle 48 by the vendor pivots the split nut portion 87 rearwardly away from the acme rod 45 so that the threads 93 of the split nut portion 87 are disengaged from the acme rod and the platform 47 may be allowed to descend by gravity or pushed down toward the base of the machine. If desired, a spring may surround the lower portion of the acme rod 45 and bear against the bottom of the platform 47 to normally urge it upwardly while it is heavily loaded and thereby assist in elevating a heavily loaded platform.

After the handle 48 has been pulled forwardly by the operator and the platform 47 lowered sufficiently to receive the new supply of newspapers the vendor releases the handle 48 and the spring 86 moves the handle 48 rearwardly and the split nut portion 87 forwardly about the acme rod 45 and into the arcuate slot 92 in block 90 to position the threads 93 in overlapping relation with the threads on the acme rod 45. The vendor then loads a group of newspapers on the inclined surface 50 of the platform 47 with the folded edges of the newspapers facing forwardly and engagable with the vertical dispensing chute. Newspapers are stacked on the platform until the top newspaper is just below the upper edge 54 of the dispensing wedge 51. The rack 71 is latched in the horizontal position to receive a display paper N' and the display paper N' is positioned on the rack behind the glass G to complete the loading of the machine.

A battery operated quartz clock with a magnet 96 in its base may be magnetically attached to the outside of sidewall 73 of display area 27. The clock has an on-off switch with a lever 97 extending from it and into the path of the pivotal latch 78 as it moves upwardly when the displayed paper N' is dispensed. The vendor resets the clock after latching the new display paper N' in the display area. The clock may be used to monitor the sales of the vending machine by stopping the clock at the time the last paper is dispensed thereby providing the vendor with information as to the length of time it took to dispense all of the newspapers. This can be helpful in servicing the machine to provide maximum sales.

After removing the coins from the coin box the vendor closes the door 25 and locks it to place the machine in service and ready to receive the next appropriate coinage to activate the dispensing mechanism so a purchaser can operate the crank to dispense the next paper from the top of the stack on the platform.

MODIFIED FORM

Figure 12:
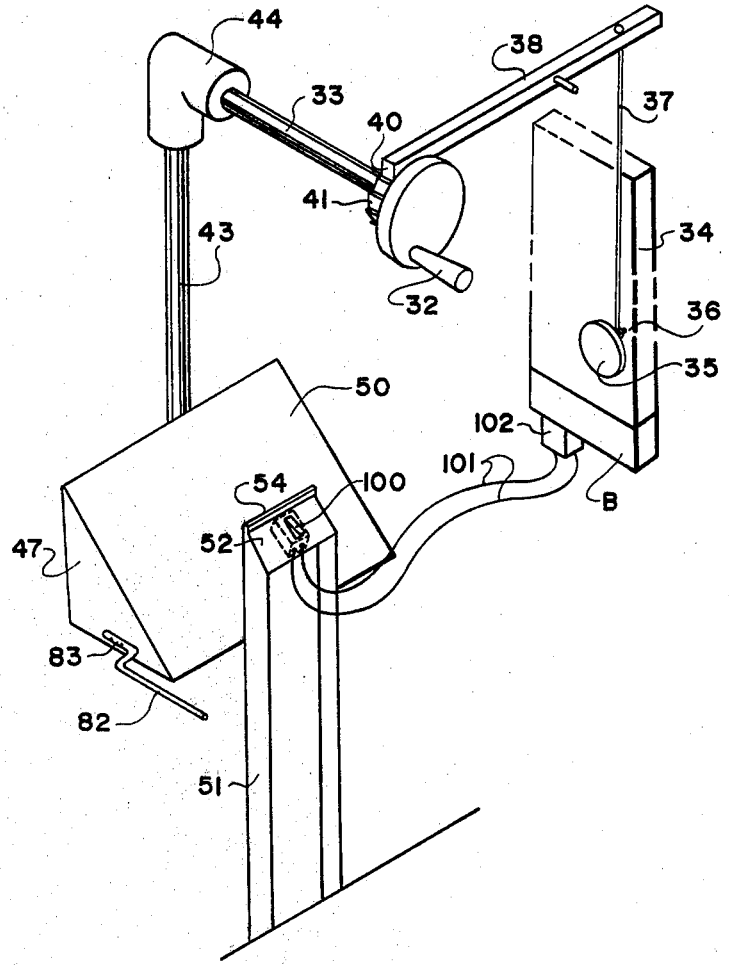
FIG. 12 is a somewhat schematic perspective view similar to FIG. 11 but illustrating a modified form of the invention wherein the locking mechanism comprises an electrical apparatus including a microswitch engagable by successively dispensed newspapers to operate a solenoid to lock the dispensing mechanism and reset the coin mechanism.

Referring to FIG. 12, a modified form of the invention is disclosed wherein the locking and reset mechanism comprising the locker lever 55 and linkage illustrated in FIG. 10 at 56 through 66 may be replaced by a microswitch 100 mounted on the inclined surface 52 of dispensing wedge 51 and engagable by successive newspapers as they pass across the surface 52. The microswitch 100 is electrically connected by wires 101 to a battery operated solenoid 102 operatively connected to the segmental gear 68 to move it downwardly to rotate the price indexing disc 35 in a counter-clockwise direction and elevate the boss 36 above its operative 5 o'clock position and back to its rest position to receive the next deposit of coins. As in the first described form of the invention movement of the boss 36 from its operative 5 o'clock position instantly raises the link 37 to pivot the free end 40 of lever 38 downwardly into engagement with the ratchet 41 of the clutch 42 and disengage the crank 32 from the drive shaft 33.

There is thus provided an improved newspaper vending machine with a simplified dispensing and locking mechanism which will reliably dispense a single newspaper of any thickness and includes the desirable features of giving visual notice when the last paper is sold and of providing information to the vendor of the time the last paper was sold.

Although specific terms have been used in the drawing and specification they are used for descriptive purposes only and not for purposes of limitation.

We claim:

1. In a newspaper vending machine having a vertically movable inclined platform supporting a group of newspapers, a stationary dispensing wedge having an inclined upper surface, a drive shaft operatively connected to the platform, a dispensing chute and means to rotate the shaft to elevate the platform and raise successive newspapers above the dispensing wedge and dispense them by gravity through a dispensing chute, the combination of a clutch between the drive shaft and the means to rotate the shaft and normally disengaging the shaft from the rotating means, means to activate the clutch and engage the shaft with the rotating means to raise the platform and dispense a newspaper.

2. In a newspaper vending machine having a cabinet and a supply of newspapers within the cabinet, vertically movable means within the cabinet for dispensing the newspapers and a display area on the cabinet for displaying one of the papers within the cabinet, the combination of means for dispensing the displayed paper after the other papers within the cabinet have been dispensed, said means comprising a pivotal rack within the display area, means pivotally mounting the rack within the display area, means pivotally mounting the rack within the display area with the rack normally depending from its pivotal connection, latch means engagable with the rack to support it in a horizontal plane and support a display newspaper within the display area, and means responsive to elevation of said vertically movable means to release the latch and permit the rack to depend from its pivotal connection to dispense the display newspaper.

3. A structure according to claim 2 wherein a clock is mounted in the cabinet, said clock having an on-off switch, and a lever extending from the on-off switch into the path of travel of the pivotal latch after it is engaged by the elevation of the platform to stop the clock.

4. A newspaper vending machine according to claim 1 wherein said clutch is a wrap spring clutch including a ratchet.

5. A structure according to claim 4 including a coin mechanism and wherein said means to activate the clutch comprises a lever selectively engageable with the ratchet, and means responsive to insertion of coins in said coin mechanism to disengage said lever from the ratchet and activate the clutch to engage the shaft with the rotating means.

6. A structure according to claim 5 including means responsive to the dispensing of a newspaper to move said lever into engagement with the ratchet to deactivate the clutch and disengage the shaft from the rotating means.

7. A structure according to claim 6 wherein said last named means is electrically operable and includes a micro-switch in the path of successively dispensed newspapers, a solenoid electrically connected to the micro-switch and to a source of electrical power, and means operatively connecting the solenoid to the lever to move it into engagement with the ratchet.

* * * * *